US010414156B2

(12) United States Patent
Nozawa

(10) Patent No.: US 10,414,156 B2
(45) Date of Patent: Sep. 17, 2019

(54) INKJET PRINTER AND PRINTING METHOD

(71) Applicant: Roland DG Corporation, Hamamatsu-shi, Shizuoka (JP)

(72) Inventor: Akinaga Nozawa, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 15/814,466

(22) Filed: Nov. 16, 2017

(65) Prior Publication Data

US 2018/0134032 A1 May 17, 2018

(30) Foreign Application Priority Data

Nov. 17, 2016 (JP) ..... 2016-224115

(51) Int. Cl.

| | |
|---|---|
| ***B41J 2/045*** | (2006.01) |
| ***B41J 2/165*** | (2006.01) |
| ***B41J 2/21*** | (2006.01) |
| ***B41J 25/34*** | (2006.01) |
| *B41J 2/14* | (2006.01) |

(52) U.S. Cl.

CPC ..... *B41J 2/0451* (2013.01); *B41J 2/04581* (2013.01); *B41J 2/16579* (2013.01); *B41J 2/2139* (2013.01); *B41J 2/2142* (2013.01); *B41J 25/34* (2013.01); *B41J 2002/14354* (2013.01); *B41J 2002/1657* (2013.01)

(58) Field of Classification Search

CPC .. B41J 2/0451; B41J 2/04581; B41J 2/16579; B41J 2/2139; B41J 2/2142; B41J 25/34

See application file for complete search history.

(56) References Cited

U.S. PATENT DOCUMENTS

| | | | | |
|---|---|---|---|---|
| 5,581,284 | A * | 12/1996 | Hermanson | B41J 2/04505 347/40 |
| 6,517,184 | B1 * | 2/2003 | Bruch | B41J 2/16579 347/19 |
| 7,506,945 | B2 * | 3/2009 | Noguchi | B41J 2/2128 347/12 |
| 8,814,316 | B2 * | 8/2014 | Kido | B41J 2/2139 347/14 |
| 2005/0063016 | A1 | 3/2005 | Takahashi et al. | |
| 2015/0259784 | A1 * | 9/2015 | Goto | B05B 1/00 427/8 |

FOREIGN PATENT DOCUMENTS

| | | |
|---|---|---|
| JP | 2004-174816 A | 6/2004 |
| JP | 2005-41009 A | 2/2005 |

* cited by examiner

*Primary Examiner* — Lamson D Nguyen

(74) *Attorney, Agent, or Firm* — Keating & Bennett, LLP

(57) ABSTRACT

An inkjet printer includes a table for a recording medium, an injection head including nozzles arrayed in a first direction, the injection head injecting ink toward the recording medium, a movement mechanism moving, in the first direction, one of the table and the injection head with respect to the other of the table and the injection head, and a controller communicably connected with the injection head and the movement mechanism, the controller driving the injection head and the movement mechanism. The controller includes a printing controller printing an image by using portion of the plurality of nozzles, the portion being selected based on a nozzle check to determine if any of the nozzles has an injection defect.

16 Claims, 7 Drawing Sheets

INKJET PRINTER AND PRINTING METHOD

CROSS REFERENCE TO RELATED APPLICATIONS

This application claims the benefit of priority to Japanese Patent Application No. 2016-224115 filed on Nov. 17, 2016. The entire contents of this application are hereby incorporated herein by reference.

BACKGROUND OF THE INVENTION

1. Field of the Invention

The present invention relates to an inkjet printer and a printing method.

2. Description of the Related Art

Conventionally, inkjet printers forming an image on a medium (recording medium) by use of ink are known. Such an inkjet printer injects ink of a plurality of colors such as, for example, cyan (C), magenta (M), yellow (Y), black (K) and the like respectively from a plurality of nozzles of an injection head and mixing such a plurality of colors of ink on a medium to form a desired image.

In the case where, for example, the inkjet printer is not used for a long time, the nozzles may be clogged. In the case where trace amounts of air are incorporated into the ink, air entrainment may occur. In such cases, any of the plurality of nozzles may have an injection defect. When this occurs, a user performs head cleaning or the like in order to solve the injection defect. In the case where such a work does not solve the injection defect, it is generally necessary to ask a maintenance personnel to replace the injection head. However, there are cases where, for example, the physical distance between the user and the maintenance personnel is long, the maintenance personnel has another appointment and cannot come to the user in a short time, or the injection defect occurs during the night or weekend. In such cases, it requires quite a long time to complete the replacement of the injection head after the injection defect occurs. During this time, the user cannot perform printing while the printing image quality is maintained, and has no choice but to stop printing.

Regarding this problem, for example, Japanese Laid-Open Patent Publication No. 2004-174816 discloses a technology that allows printing to be continued with no need to replace the injection head while there is a nozzle having an injection defect. An inkjet printer disclosed in Japanese Laid-Open Patent Publication No. 2004-174816 interpolates, by another color, the color of ink dots that should be printed by the nozzle detected as having an injection defect, and thus performs printing. For example, in the case where a nozzle for cyan (C) is detected as having an injection defect, ink is injected from a nozzle of light cyan (LC) to the position to which the ink should be injected from the nozzle for cyan (C).

However, with the inkjet printer disclosed in Japanese Laid-Open Patent Publication No. 2004-174816, the color reproducibility is decreased, and the decline in the image quality is conspicuous in the case where, for example, the printed image is of a certain hue. For these reasons, it is desired to develop an inkjet printer capable of continuing printing without decreasing the image quality until the injection head is replaced after an injection defect occurs.

SUMMARY OF THE INVENTION

In light of such a situation, preferred embodiments of the present invention provide inkjet printers and printing methods capable of continuing printing without decreasing image quality even if an injection defect occurs to a nozzle.

An inkjet printer according to a preferred embodiment of the present invention includes a table on which a recording medium is placed; an injection head including a plurality of nozzles arrayed in a first direction, the injection head injecting ink toward the recording medium; a movement mechanism moving, in the first direction, one of the table and the injection head with respect to the other of the table and the injection head; and a controller communicably connected with the injection head and the movement mechanism, the controller driving the injection head and the movement mechanism. The controller is configured or programmed to include a printing controller printing an image by use of a portion of the plurality of nozzles selected based on a nozzle check to determine whether or not any of the plurality of nozzles has an injection defect.

In the case where an injection defect occurs in any of the plurality of nozzles, the inkjet printer according to a preferred embodiment of the present invention performs printing without using a nozzle or nozzles having the injection defect. In other words, the inkjet printer may perform printing by using the nozzles other than the nozzle having the injection defect. Therefore, the printing image quality is prevented from being changed after the occurrence of the injection defect. Accordingly, for example, even during the period after the injection defect occurs until the injection head is replaced by a maintenance personnel, the user may continue printing with no decrease in the image quality.

A printing method according to a preferred embodiment of the present invention is performed by use of an inkjet printer including a table on which a recording medium is placed; an injection head including a plurality of nozzles arrayed in a first direction, the injection head injecting ink toward the recording medium; a movement mechanism moving, in the first direction, one of the table and the injection head with respect to the other of the table and the injection head; and a controller communicably connected with the injection head and the movement mechanism, the controller driving the injection head and the movement mechanism. The printing method includes a nozzle check step of performing a nozzle check of detecting whether or not any of the plurality of nozzles has an injection defect; a nozzle selection step of selecting a nozzle from which the ink is to be injected, from the plurality of nozzles, based on results of the nozzle check; and a printing execution step of printing an image by use of the selected nozzle.

Preferred embodiments of the present invention provide an inkjet printer and a printing method capable of continuing printing with no decrease in the image quality even if an injection defect occurs to a nozzle.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the attached drawings. The preferred embodiments of the present invention described below are not intended to specifically limit the present invention. Components and portions that have the same functions will bear the same reference signs, and overlapping descriptions will be omitted or simplified optionally.

Figure 1:
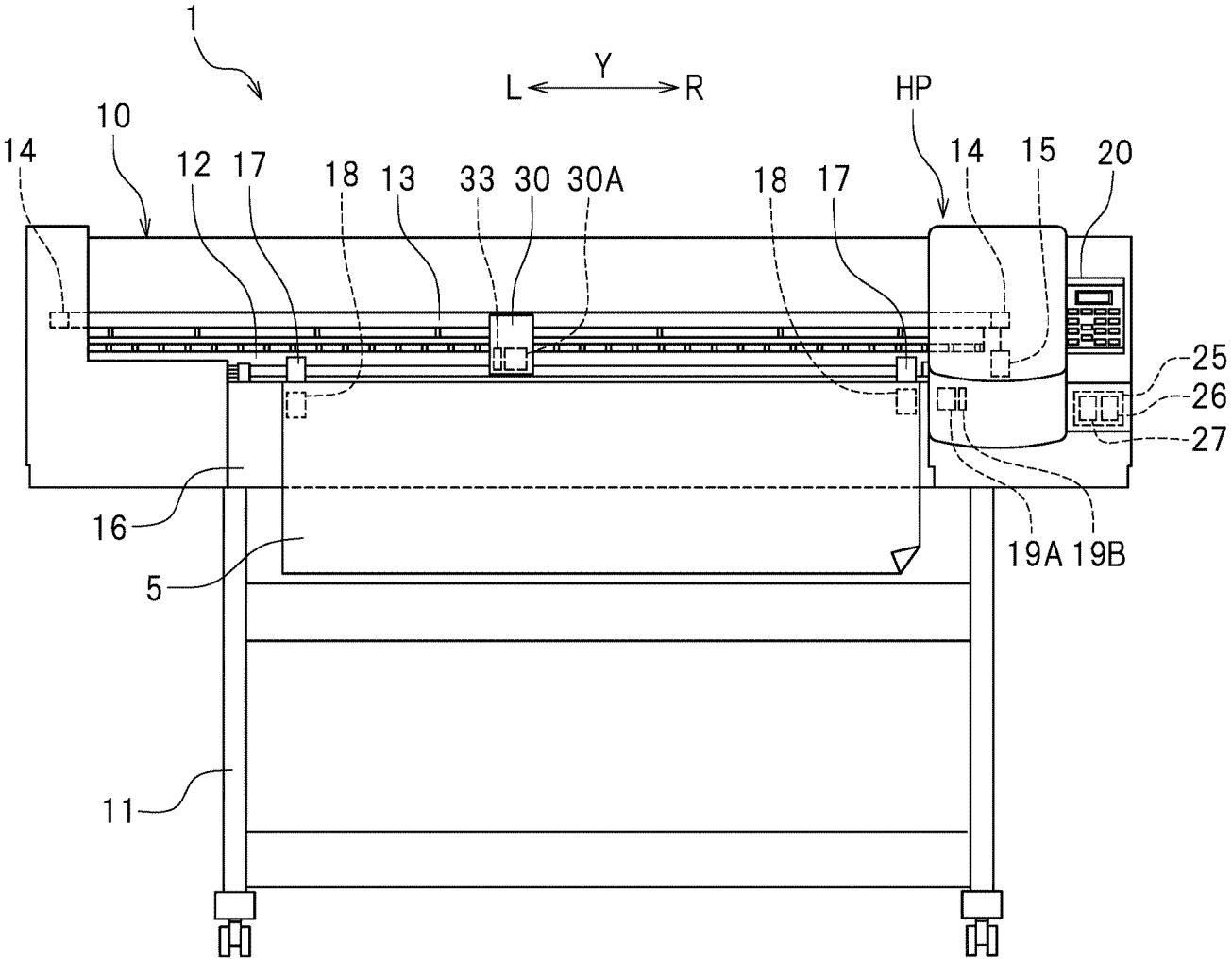
FIG. 1 is a front view of an inkjet printer according to a preferred embodiment of the present invention.

FIG. 1 is a front view of a large-scale inkjet printer (hereinafter, referred to simply as a "printer") 1 according to a preferred embodiment of the present invention. In the following description, a direction in which a user facing a front surface of the printer 1 (facing the surface shown in FIG. 1) extends away from the printer 1 will be referred to as "forward", and a direction in which such a user approaches the printer 1 will be referred to as "rearward". In the drawings, letter Y represents a main scanning direction, and letter X represents a sub scanning direction perpendicular to the main scanning direction. In the drawings, letters F, Rr, L and R respectively represent "front", "rear", "left" and "right". These directions are provided merely for the sake of convenience, and do not limit the manner of installation or the like of the inkjet printer 1.

The printer 1 moves a medium 5 forward sequentially and injects ink from an injection head 30A moving in the main scanning direction Y to print an image on the medium 5. The medium 5 is a printing target on which an image is to be printed. There is no specific limitation on the material of the medium 5. The medium 5 may be, for example, paper such as plain paper, printing paper for inkjet printers, or the like; a transparent sheet formed of a resin, glass or the like; or a sheet formed of a metal material, rubber or the like.

In this specification, the term "inkjet printer" refers to any printer using a printing method of a conventionally known inkjet technology, for example, a continuous method such as a binary deflection method, a continuous deflection method or the like; or an on-demand method such as a thermal method, a piezoelectric element method or the like.

The printer 1 includes a printer main body 10, legs 11 supporting the printer main body 10 and a controller 25. The printer main body 10 extends in the main scanning direction Y. The printer main body 10 includes a guide rail 12 and a carriage 30 engaged with the guide rail 12. The guide rail 12 guides the carriage 30 to move in the main scanning direction Y. The guide rail 12 extends in the main scanning direction Y. An endless belt 13 is secured to the carriage 30. The belt 13 is wound along pulleys 14 provided at a left end and a right end of the guide rail 12. A carriage motor 15 is attached to the pulley 14 at the right end. The carriage motor 15 is electrically connected with the controller 25. The carriage motor 15 is controlled by the controller 25. When the carriage motor 15 is driven, the pulleys 14 are rotated, and the belt 13 runs. Then, the carriage 30 is moved in the main scanning direction Y along the guide rail 12. In this preferred embodiment, the belt 13, the pulleys 14 and the carriage motor 15 are included in a main scanning direction movement mechanism that moves the carriage 30 in the main scanning direction Y.

A platen 16 is located below the carriage 30. The platen 16 extends in the main scanning direction Y. The medium 5 is located on the platen 16. A pinch roller 17 pressing the medium 5 from above is provided above the platen 16. A grit roller 18 is provided at a position on the platen 16 that corresponds to the pinch roller 17. The grit roller 18 is coupled with a feed motor (not shown). The grit roller 18 is adapted to be rotatable upon receipt of a driving force of the feed motor. The feed motor is electrically connected with the controller 25. The feed motor is controlled by the controller 25. When the grit roller 18 is rotated in the state where the medium 5 is held between the pinch roller 17 and the grit roller 18, the medium 5 is transported in the sub scanning direction X. In this preferred embodiment, the pinch roller 17, the grit roller 18 and the feed motor are included in a sub scanning direction movement mechanism that moves the medium 5 in the sub scanning direction X.

Figure 2:
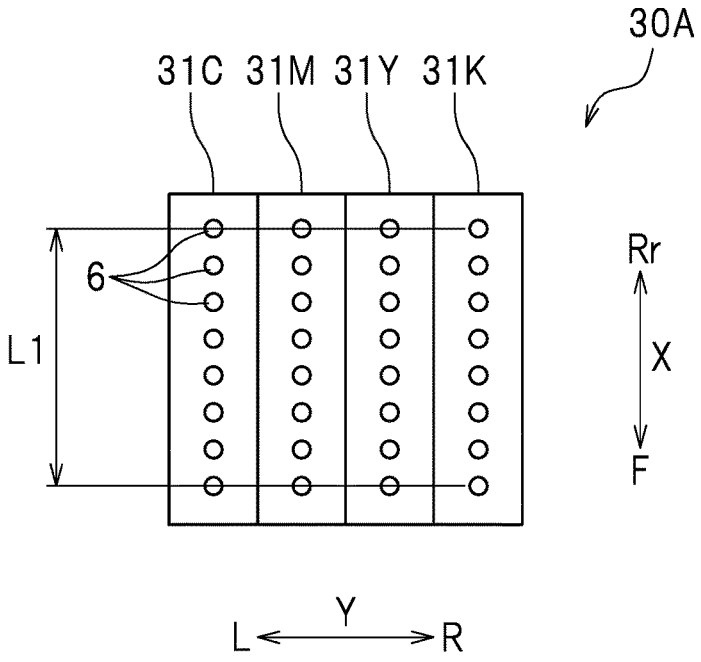
FIG. 2 is a schematic view showing a structure of a bottom surface of an injection head according to a preferred embodiment of the present invention.

The carriage 30 waits at a home position HP at the right end of the guide rail 12 when not performing a printing operation. The carriage 30 includes one injection head 30A. FIG. 2 is a schematic view showing a structure of a surface of the injection head 30A that faces the medium 5 (in this preferred embodiment, a bottom surface of the injection head 30A). The injection head 30A includes four head portions 31C, 31M, 31Y and 31K injecting ink. The head portions 31C, 31M, 31Y and 31K are arrayed in the main scanning direction Y. The head portions 31C, 31M, 31Y and 31K each inject process color ink usable to form a color image. The head portion 31C injects cyan ink. The head portion 31M injects magenta ink. The head portion 31Y injects yellow ink. The head portion 31K injects black ink. There is no limitation on the number of colors or the hue of the ink.

The head portions 31C, 31M, 31Y and 31K each include a plurality of nozzles 6 arrayed in the sub scanning direction X (in other words, in the front-rear direction). In each of the head portions 31C, 31M, 31Y and 31K, the plurality of nozzles 6 are arrayed in a line to define a nozzle line. Namely, the injection head 30A preferably includes four nozzle lines, for example. The length of the nozzle line, namely, length L1 from the center of the nozzle 6 located at the foremost position to the center of the nozzle 6 located at the rearmost position, is equal or substantially equal among the head portions 31C, 31M, 31Y and 31K. In FIG. 2, the head portions 31C, 31M, 31Y and 31K are shown as including eight nozzles 6. In actuality, the nozzles 6 are provided in a greater number. There is no limitation on the number or the locations of the nozzles 6.

The head portions 31C, 31M, 31Y and 31K each accommodate a pressure chamber (not shown) having an ink stored therein, a vibration plate (not shown) defining a portion of the pressure chamber, and an actuator (not shown) coupled with the vibration plate. The actuator includes a piezoelectric element or the like. The pressure chamber is in communication with the nozzles 6. The actuator is electrically connected with the controller 25. When the controller 25 supplies a driving signal to the actuator, the actuator is deformed, and accordingly, the vibration plate is deformed. As a result, the pressure of the ink in the pressure chamber is changed, and thus the ink is injected from the nozzles 6 toward the medium 5.

The head portions 31C, 31M, 31Y and 31K are respectively communicated with ink cartridges (not shown) via ink supply paths (not shown). The ink cartridges are detachably located at, for example, a right end of the printer main body 10. There is no limitation on the material of the ink. Any of various materials conventionally used as ink materials for inkjet printers is usable. The ink may be, for example, solvent-based pigment ink or aqueous pigment ink. Alternatively, the ink may be aqueous dye ink, ultraviolet-curable pigment ink curable when being exposed to ultraviolet light, or the like.

The printer main body 10 accommodates an exhaust ink container 19A and a wiper 19B inner to the home position HP. The exhaust ink container 19A is opened upward. The exhaust ink container 19A is a container receiving the ink injected from the nozzles 6 of the injection head 30A. When the ink inside the injection head 30A is exposed to air, the viscosity of the ink is increased, and the injection performance may be changed. In order to avoid this, the injection head 30A makes an operation of injecting the ink from the nozzles 6 toward the exhaust ink container 19A when necessary. The exhaust ink container 19A recovers the ink injected from the nozzles 6. The wiper 19B cleans a surface of the injection head 30A on the side of the nozzles 6 (cleans the nozzle surface). In the state where the injection head 30A is at the home position HP, the nozzle surface of the injection head 30A is rubbed by the wiper 19B appropriately. This removes unnecessary ink, dust or the like attached to the nozzle surface. In this specification, the operation of the injection head 30A of injecting the ink toward the exhaust ink container 19A, and an operation of the wiper 19B of cleaning the nozzle surface of the injection head 30A, will be referred to as a "cleaning operation".

An operation panel 20 is provided at the right end of the printer main body 10. The operation panel 20 includes a display displaying an operation state, input keys operable by the user, and the like. Inside the operation panel 20, the controller 25 controlling operations of various components of the printer 1 is accommodated. The controller 25 is communicably connected with the feed motor, the carriage motor 15 and the actuator, and is adapted to control these components.

There is no specific limitation on the structure of the controller 25. The controller 25 is, for example, a microcomputer. There is no specific limitation on the hardware structure of the microcomputer. The controller 25 includes, for example, an interface (I/F) receiving printing data or the like from an external device such as a host computer or the like. a central processing unit (CPU) executing an instruction from a control program, a ROM (read only memory) storing the program executable by the CPU, a RAM (random access memory) usable as a working area in which the program is developed, a storage device, such as a memory or the like, storing the above-described program and various types of data, and the like. The controller 25 does not need to be provided inside the printer main body 10. The controller 25 may be, for example, a computer or the like that is installed outside the printer main body 10 and is communicably connected with the printer main body 10 via a wire or wirelessly.

Figure 3:
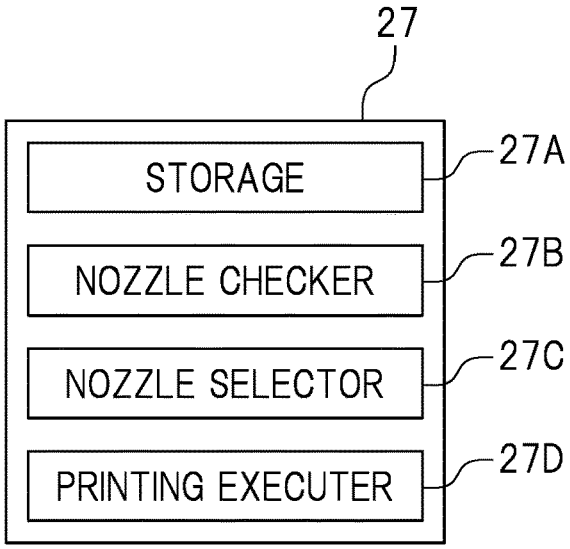
FIG. 3 is a block diagram showing a portion of components of a second printing portion.

The controller 25 includes a first printing portion 26 and a second printing portion (printing controller) 27. The first printing portion 26 is configured or programmed to control the entire operation of the printer 1 in a normal state, namely, in the state where no injection defect occurs to any nozzle 6. The second printing portion 27 is configured or programmed to control the entire operation of the printer 1 in the state where an injection defect occurs to a nozzle 6. FIG. 3 is a block diagram showing a portion of components of the second printing portion 27. As shown in FIG. 3, the second printing portion 27 includes a storage 27A, a nozzle checker 27B, a nozzle selector 28C, and a printing executer 27D. These components are adapted to be mutually communicated when necessary. These components may be realized by hardware or may be realized functionally by the CPU executing a computer program. These components may be realized by processors.

Figure 4A:
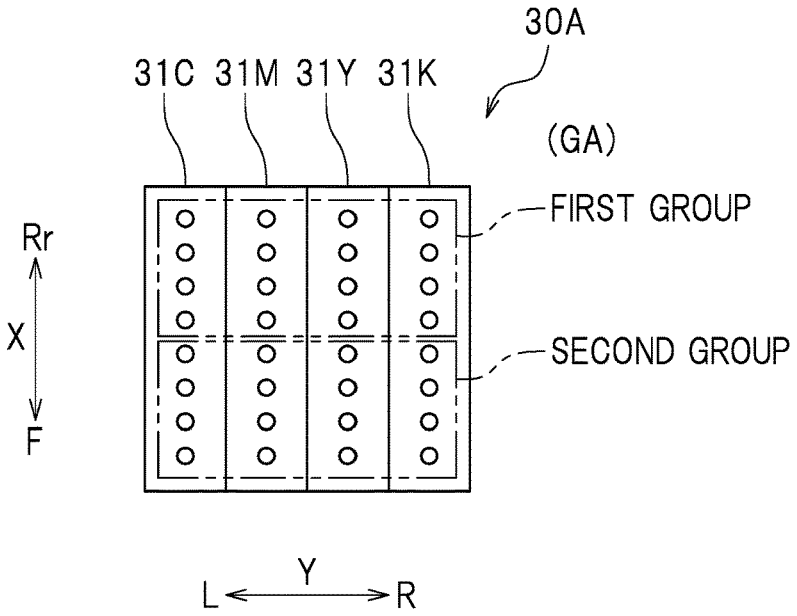
FIGS. 4A and 4B are each a schematic view showing grouping on nozzles according to a preferred embodiment of the present invention.
Figure 4B:
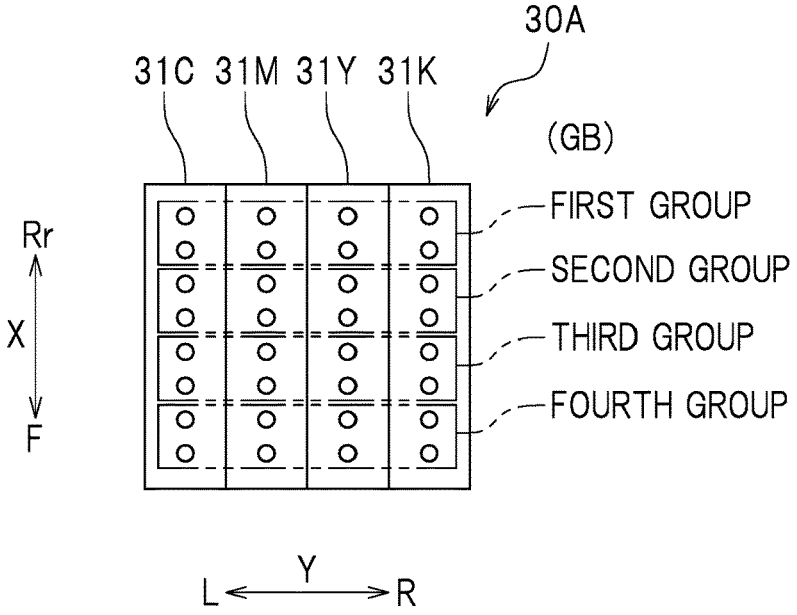

The storage 27A has, stored thereon, information on grouping on the nozzles 6. The grouping is predefined in accordance with the structure of the printer 1, for example, the number or the location(s) of the injection head(s), the number of the head portions, the number of the colors, the number of the nozzle lines or the like. FIGS. 4A and 4B are schematic views each showing grouping on the nozzles 6 in a preferred embodiment of the present invention. In the preferred embodiment shown in FIG. 4A, the plurality of nozzles 6 defining the nozzle line in each of the head portions 31C, 31M, 31Y and 31K are grouped into a first group including four nozzles 6 on the rear side in the sub scanning direction X and a second group including four nozzles 6 on the front side in the sub scanning direction X. For the sake of explanation, the grouping shown in FIG. 4A will be referred to as "grouping GA" hereinafter. In the preferred embodiment shown in FIG. 4B, the plurality of nozzles 6 defining the nozzle line in each of the head portions 31C, 31M, 31Y and 31K are grouped into a first group, a second group, a third group and a fourth group, which include the same number of nozzles 6 and are arrayed from the rear end of the sub scanning direction X. For the sake of explanation, the grouping shown in FIG. 4B will be referred to as "grouping GB" hereinafter.

In FIGS. 4A and 4B, the plurality of nozzles 6 are grouped into two groups and four groups respectively. The number of groups into which the plurality of nozzles 6 are grouped is not limited to two or four. The plurality of nozzles 6 may be grouped into an even number of groups or an odd number of groups. The plurality of nozzles 6 may be grouped into, for example, five or more groups. The number of groups into which the plurality of nozzles 6 are grouped may be the same as the number of nozzle 6 included in the nozzle line. The number of nozzles 6 included in one group may be two or more, or one. A same number of nozzles 6 may be included in all the groups, or different numbers of nozzles 6 may be included in different groups.

The nozzle checker 27B is configured or programmed to perform a nozzle check to detect whether or not any of the nozzles 6 has an injection defect. The nozzle selector 27C selects nozzles 6, among the plurality of nozzles 6, from which the ink is to be injected for printing, based on the results of the nozzle check. The printing executer 27D uses the selected nozzles 6 to print an image.

For printing, data on the image to be printed or the like is input to the controller 25. The controller 25 performs printing based on the data. In the normal state, namely, in the state where there is no nozzle 6 having an injection defect, the first printing portion 26 controls the entire operation of the printer 1. The first printing portion 26 controls the feed motor such that the medium 5 is fed forward sequentially. The first printing portion 26 drives the carriage motor 15 to move the carriage 30 in the main scanning direction Y, and drives the actuator to inject the ink from the injection head 30A, so that the ink arrives on a printing surface of the medium 5. The first printing portion 26, for example, moves the carriage 30 in the main scanning direction Y once or a plurality of times each time the medium 5 is fed forward.

By contrast, in the case where an abnormal state occurs, for example, in the case where a dot is missing, or a white stripe appears, on the printed item, and thus printing results as expected are not provided, the user performs head cleaning. Namely, the injection head 30A, at the home position HP, injects the ink toward the exhaust ink container 19A, and/or the wiper 19B cleans the nozzle surface of the injection head 30A. In the case where even such an operation does not solve the abnormal state of the printed item, the controller 25 switches the first printing portion 26 into the second printing portion 27. The second printing portion 27 controls the entire operation of the printer 1.

Figure 5:
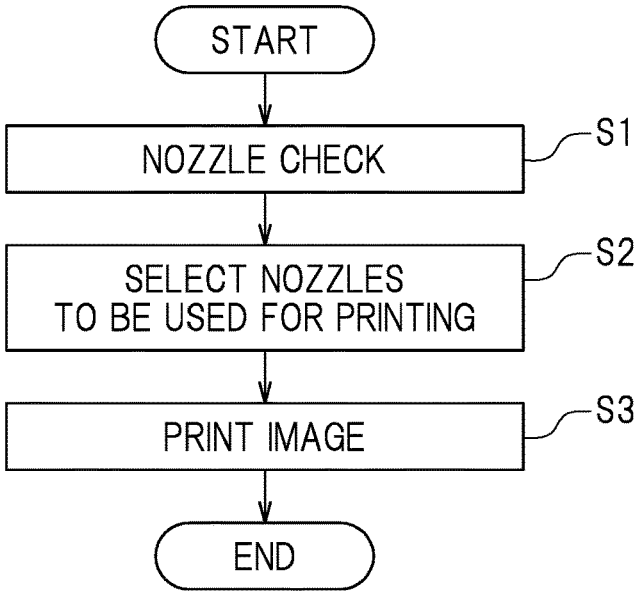
FIG. 5 is a flowchart showing a procedure of a printing method according to a preferred embodiment of the present invention.

FIG. 5 is a flowchart showing a procedure of a printing method performed by the second printing portion 27 in a preferred embodiment. In this preferred embodiment, first, the nozzle check of checking whether or not any of the nozzles 6 has an injection defect is performed (step S1). Based on the results of the nozzle check, the nozzles 6 to be used for the printing are selected from the plurality of nozzles 6 (step S2). Next, the selected nozzles 6 are used to perform printing of an image (step S3). Hereinafter, each step will be described in detail.

In step S1, the nozzle check of checking whether or not any of the nozzles 6 has an injection defect is performed. In an example, a predetermined test pattern for the nozzle check is printed on the medium 5. Specifically, first, the user operates the operation panel 20 to instruct the printing of the test pattern. When being instructed to print the test pattern, the nozzle checker 27B of the second printing portion 27 causes the plurality of nozzles 6 in each of the head portions 31C, 31M, 31Y and 31K to inject the ink toward the medium 5. Thus, the predetermined test pattern for the nozzle check is printed on the medium 5.

Figure 6:
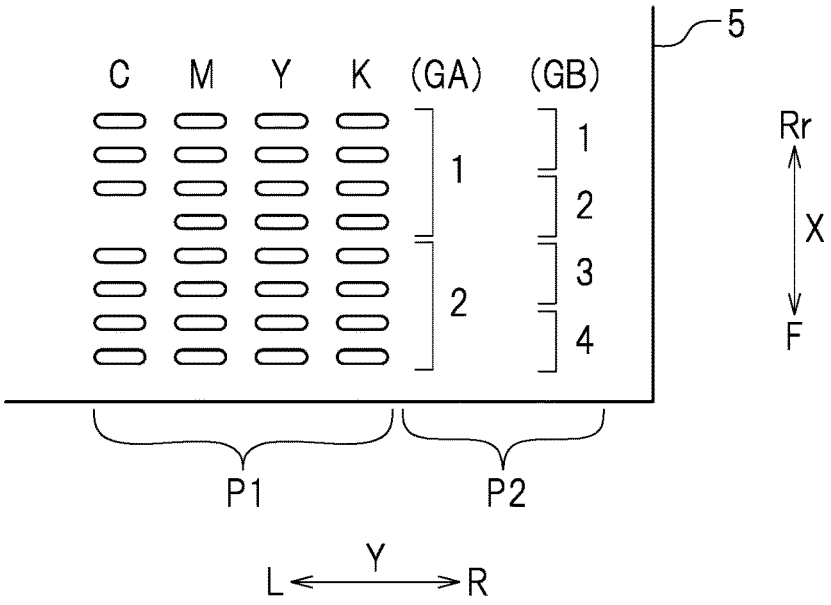
FIG. 6 is a schematic view of a test pattern for a nozzle check according to a preferred embodiment of the present invention.

FIG. 6 is a schematic view of the test pattern for the nozzle check in a preferred embodiment of the present invention. The test pattern for the nozzle check includes a predetermined test printing pattern portion P1 and a grouping display portion P2 showing the grouping on the nozzles 6. The test printing pattern portion P1 includes ink dots corresponding to the nozzles 6 in each of the head portions 31C, 31M, 31Y and 31K. In FIG. 6, letters C, M, Y and K each represent the color of the ink. Namely, letters C, M, Y and K represent the correspondence with the head portions 31C, 31M, 31Y and 31K. The grouping display portion P2 showing the grouping on the nozzles 6 represent the relationship between the test printing pattern P1 and grouping GA and grouping GB on the nozzle 6 stored on the storage 27A of the second printing portion 27. According to this test pattern, the grouping display portion P2 is printed together with the test printing pattern P2. Therefore, the user easily learns the correspondence between the position at which the abnormal state such as, for example, a missing dot or the like occurs and the nozzle 6 having an injection defect. It is preferred that the grouping display portion P2 is printed with the ink injected from all the head portions 31C, 31M, 31Y and 31K. In this manner, even in the case where one of the plurality of nozzles 6 has an injection defect, the grouping display portion P2 is provided properly.

In step S2, the nozzle 6 having an injection defect is specified based on the results of the nozzle check. In an example, the user visually checks the test pattern for the nozzle check to specify the position of the nozzle 6 having the injection defect. For example, in the test printing pattern P1 shown in FIG. 6, the fourth dot from the rear end in the leftmost line, namely, the line for C, is missing. Thus, the user understands that the fourth nozzle 6 from the rear end of the head portion 31C has the injection defect. Therefore, the user specifies that the nozzle 6 having the injection defect is included in the first group of grouping GA or in the second group of grouping GB. In other words, the user specifies that the nozzle 6 having the injection defect is not included in the second group of grouping GA or in the first, third or fourth group in grouping GB.

In an example, next, the user selects a group with no injection defect from the groups shown in the grouping display portion P2 in FIG. 6, and inputs such a group to the nozzle selector 27 of the second printing portion 27. From the grouping display portion P2 in FIG. 6, the user may select, for example, the second group of grouping GA as the group with no injection defect, and may input this group to the nozzle selector 27C. In the case where the groups in one type of grouping include a plurality of groups that are selectable, the user may all such groups or a portion of such groups. Namely, the user may select the first group, the third group and the fourth group of grouping GB as the groups with no injection defect from the grouping display portion P1 in FIG. 6, and may input these groups to the nozzle selector 27C.

The nozzle selector 27C is adapted to select the nozzles 6 to be used for the printing, based on the information on the group(s) input by the user. The nozzle selector 27C is adapted to, for example, select the nozzles 6 included in the group(s) input by the user, as the nozzles 6 to be used for the printing. Specifically, the nozzle selector 27C is adapted to, in the case where, for example, the user inputs the second group of grouping GA as the group with no injection defect, select the nozzles 6 included in the second group of grouping GA as the nozzles 6 to be used for the printing.

The nozzle selector 27C may be adapted to, in the case where the user selects a plurality of groups with no defect, select the nozzles 6 in all these groups as the nozzles to be used for the printing, or select the nozzles 6 in only a portion of the groups as the nozzles to be used for the printing. In a preferred embodiment of the present invention, the nozzle selector 27C is adapted to select, from the groups selected by the user, the nozzles 6 in a plurality of groups continuously arrayed in the sub scanning direction X, such that the number of the selected nozzles 6 is maximum. For example, the nozzle selector 27C is adapted to, in the case where the user inputs the first group, the third group and the fourth group of grouping GB as the groups with no defect, select the nozzles 6 in the third group and the fourth group continuously arrayed in the sub scanning direction X as the nozzles to be used for the printing. The nozzles 6 in the groups continuously arrayed in the sub scanning direction X are selected, so that the time from the injection of the ink until the ink is dried and cured is made uniform. Therefore, the efficiency of the printing is improved while the image quality is maintained high. Thus, the effect of the technology disclosed herein is better provided.

In another example, the user selects the group with an injection defect from the grouping display portion P2 shown in FIG. 6, and inputs the group to the nozzle selector 27C.

The nozzle selector 27C is adapted to select the nozzles 6 to be used for the printing from the groups other than the group input by the user. For example, the nozzle selector 27C is adapted to, in the case where the user inputs the second group of grouping GB as the group with an injection defect, recognize the nozzles 6 in the groups other than the second group of grouping GB as the nozzles 6 usable for the printing. Namely, the nozzle selector 27C is adapted to recognize the nozzles 6 included in at least one of the first group, the third group and the fourth group of grouping GB as the nozzles to be used for the printing. In this case, the nozzle selector 27C may select the group to be used for the printing from the first group, the third group and the fourth group of grouping GB, like in the case where the user selects a plurality of groups with no injection defect.

In step S3, the selected nozzles 6 are used to print a desired image. Specifically, first, the printing executer 27D changes the control specificities such that an image in a printing region that was to be printed by use of all the nozzles 6 is now printed with only a portion of the nozzles 6 that have been selected in step S2. For example, it is assumed that in step S2, the nozzles 6 included in the second group of grouping GA are selected to be used for the printing. In this case, the printing executer 27D changes the control specificities such that an image in a printing region that was to be printed by use of the nozzles 6 included in the first group of grouping GA, and an image in a printing region that was to be printed by use of the nozzles 6 included in the second group of grouping GA, are both printed by use of the nozzles 6 included in the second group of grouping GA. In this example, the length of the nozzle line of the nozzles 6 included in the second group of grouping GA is half of length L1 of the nozzle line of all the nozzles 6. Therefore, the region on which the printing is performed while the carriage 30 is moved once in the main scanning direction Y is half of the region in the case where the printing is performed by the first printing portion 26. Thus, the second printing portion 27 moves the carriage 30 in the main scanning direction Y twice during the time period in which the first printing portion 26 moves the carriage 30 once in the main scanning direction Y for the printing.

The printing executer 27D also supplies a driving signal to the actuator for the nozzles 6 included in the second group of grouping GA. By contrast, the printing executer 27D does not supply a driving signal to the actuator for the nozzles 6 included in the first group of grouping GA. The nozzles 6 included in the second group of grouping GA inject the ink twice. In this manner, the image in the printing region that was to be printed by use of the nozzles 6 included in the first group of grouping GA and the image in the printing region that was to be printed by use of the nozzles 6 included in the second group of grouping GA are both printed by use of the nozzles 6 included in the second group of grouping GA.

Namely, in this preferred embodiment, the injection head 30A includes the nozzles 6 that are included in the first group and inject the ink toward a first printing region and the nozzles 6 that are included in the second group and inject the ink toward a second printing region. In the case where any of the nozzles 6 included in the first group is detected as having an injection defect in step S1, the nozzles 6 in the second group are selected in step S2. In step S3, the ink is injected from the nozzles 6 included in the second group toward the first printing region and the second printing region.

As described above, in the case where any of the plurality of nozzles 6 is detected as having an injection defect, the printer 1 performs printing without using the nozzle 6 having the injection defect. In other words, the printing is performed using the nozzles 6 other than the nozzle 6 having the injection defect. This prevents decrease in the image quality. Therefore, even in the case where there is a nozzle 6 having an injection defect, the user continues printing with no decrease in the image quality.

In this preferred embodiment, the second printing portion 27 is adapted to select the plurality of nozzles 6 continuously arrayed in the sub scanning direction X. This allows the efficiency of the printing to be improved while the image quality is maintained high. Therefore, the printing quality and the productivity of printed items is better balanced, and the effect of the technology disclosed therein is better provided.

In this preferred embodiment, the second printing portion 27 includes the storage 27A, which stores the plurality of nozzles 6 as being grouped into the plurality of groups, and is adapted to select a group including no nozzle 6 having an injection defect, from the plurality of groups. Therefore, the nozzles 6 to be used for the printing are easily selected from the plurality of nozzles 6.

In this preferred embodiment, the second printing portion 27 is adapted to, in the case where there are a plurality of groups including no nozzle 6 having an injection defect, select one group or a plurality of groups continuously arrayed in the sub scanning direction, such that the number of the nozzles 6 included in the selected group(s) is maximum. This allows the efficiency of the printing to be improved while the image quality is maintained high. Therefore, the printing quality and the productivity of printed items is better balanced, and the effect of the technology disclosed therein is better provided.

In this preferred embodiment, the second printing portion 27 includes the storage 27A, which stores the plurality of nozzles 6 as being grouped into the plurality of groups, and is adapted not to select a group including a nozzle 6 having an injection defect, from the plurality of groups. Therefore, the nozzles 6 to be used for the printing are easily selected from the plurality of nozzles 6.

In this preferred embodiment, the second printing portion 27 is adapted to cause the plurality of nozzles 6 to inject the ink toward the medium 5 to print the test pattern for the nozzle check. In this manner, it is detected whether or not any of the nozzles 6 has an injection defect even if the printer 1 does not include, for example, any sensor or the like for the nozzle check. This decreases the production cost of the printer 1.

The preferred embodiments of the present invention have been described so far. The above-described preferred embodiments are merely examples, and the present invention may be carried out in any of various other forms.

In the above-described preferred embodiments, as shown in FIG. 2, the injection head 30A preferably includes the four head portions 31C, 31M, 31Y and 31K, and the nozzles 6 are grouped in accordance with the locations thereof in the sub scanning direction X, for example. The present invention is not limited to this. FIGS. 7A through 7D are each a schematic view showing a structure of a surface of an injection head that faces the medium (structure of a bottom surface) and grouping on the nozzles 6 according to another preferred embodiment.

Figure 7A:
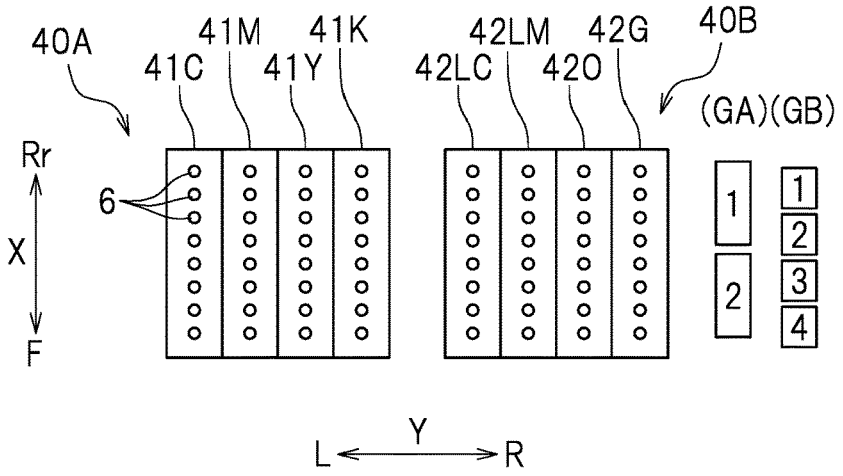
FIGS. 7A through 7D are each a schematic view showing a structure of a bottom surface of an injection head and grouping on nozzles according to another preferred embodiment of the present invention.

In the example shown in FIG. 7A, the printer preferably includes two injection heads 40A and 40B, for example. The injection head 40A and 40B are located in a so-called in-line arrangement. In other words, the injection heads 40A and 40B are arrayed in the main scanning direction Y. The injection head 40A includes four head portions 41C, 41M, 41Y and 41K arrayed in the main scanning direction Y. Letters C, M, Y and K respectively represent the same colors of ink as those described in the above preferred embodiments. The injection head 40B preferably includes four injection heads 42LC, 42LM, 420 and 42G arrayed in the main scanning direction Y, for example. The head portion 42LC injects light cyan ink. The head portion 42LM injects light magenta ink. The head portion 420 injects orange ink. The head portion 42G injects green ink. In this preferred embodiment, for example, as described above with reference to FIGS. 4A and 4B, the plurality of nozzles 6 may be grouped into a plurality of groups arrayed in the sub scanning direction X. Such grouping may be stored on the storage 27A as grouping GA or grouping GB.

Figure 7B:
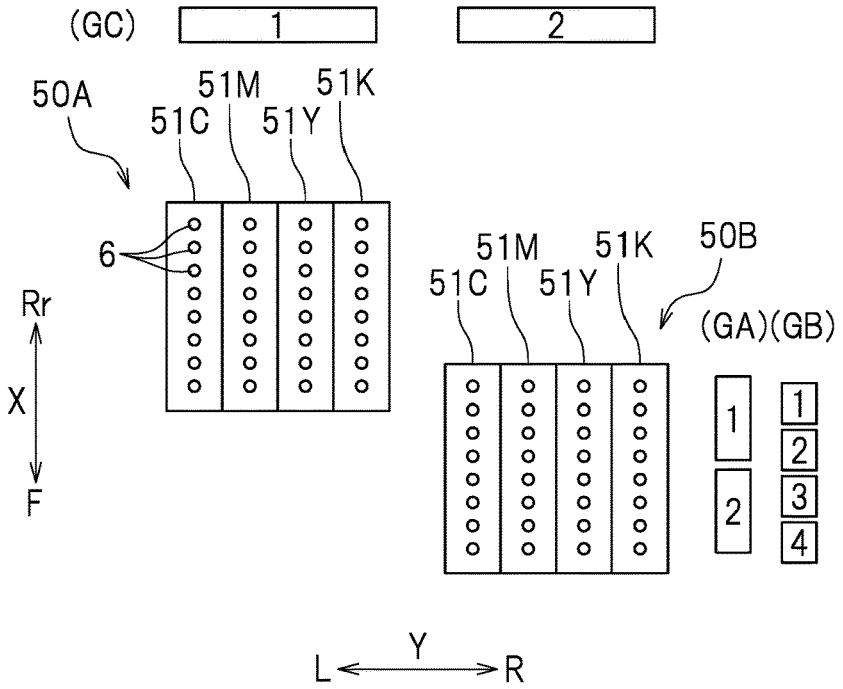

In the example shown in FIG. 7B, the printer includes two injection heads 50A and 50B. The injection heads 50A and 50B are located in a so-called staggered arrangement. In other words, the injection heads 50A and 50B are located as being shifted in the sub scanning direction X. The injection head 50B is located obliquely to the front of the injection head 50A. The injection heads 50A and 50B each include four head portions 51C, 51M, 51Y and 50K arrayed in the main scanning direction Y. Letters C, M, Y and K respectively represent the same colors of ink as those in the preferred embodiments described above with reference to FIG. 1 and the like. The injection heads 50A and 50B are adapted to inject the same colors of ink.

In this preferred embodiment, for example, grouping GC, by which the nozzles 6 included in the injection head 50A are grouped into a first group and the nozzles 6 included in the injection head 50B are grouped into a second group, may be stored on the storage 27A. In this case, in step S2 in the preferred embodiments described above with reference to FIG. 1 and the like, the nozzles 6 included in either the injection head 50A or 50B may be selected as the nozzles 6 to be used for the printing. Alternatively, in this preferred embodiment, as described above with reference to FIGS. 4A and 4B, the plurality of nozzles 6 may be grouped into a plurality of groups arrayed in the sub scanning direction X in each of the injection heads 50A and 50B. Such grouping may be stored on the storage 27A as grouping GA or grouping GB.

Figure 7C:
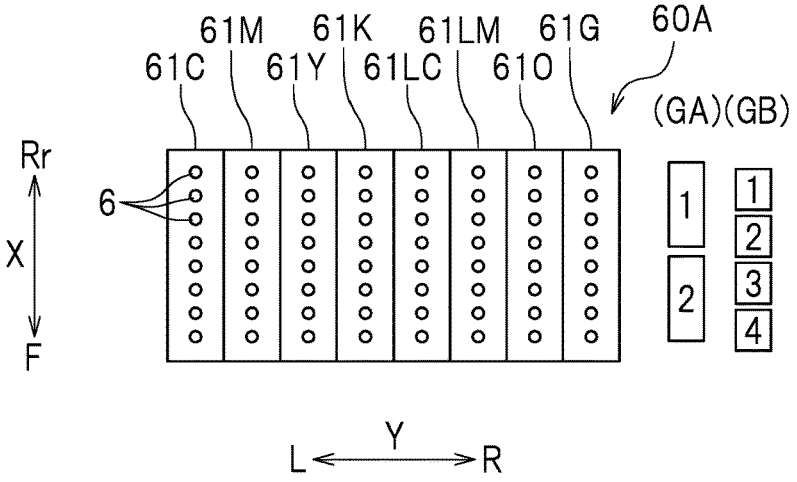

In the example shown in FIG. 7C, the printer includes one injection head 60A. The injection head 60A preferably includes eight head portions 61C, 61M, 61Y, 61K, 61LC, 61LM, 610 and 61G arrayed in the main scanning direction Y, for example. Letters C, M, Y, K, LC, LM, 0 and G respectively represent the same colors of ink as those described above with reference to FIG. 7A. In this preferred embodiment, for example, as described above with reference to FIGS. 4A and 4B, the plurality of nozzles 6 may be grouped into a plurality of groups arrayed in the sub scanning direction X. Such grouping may be stored on the storage 27A as grouping GA or grouping GB.

Figure 7D:
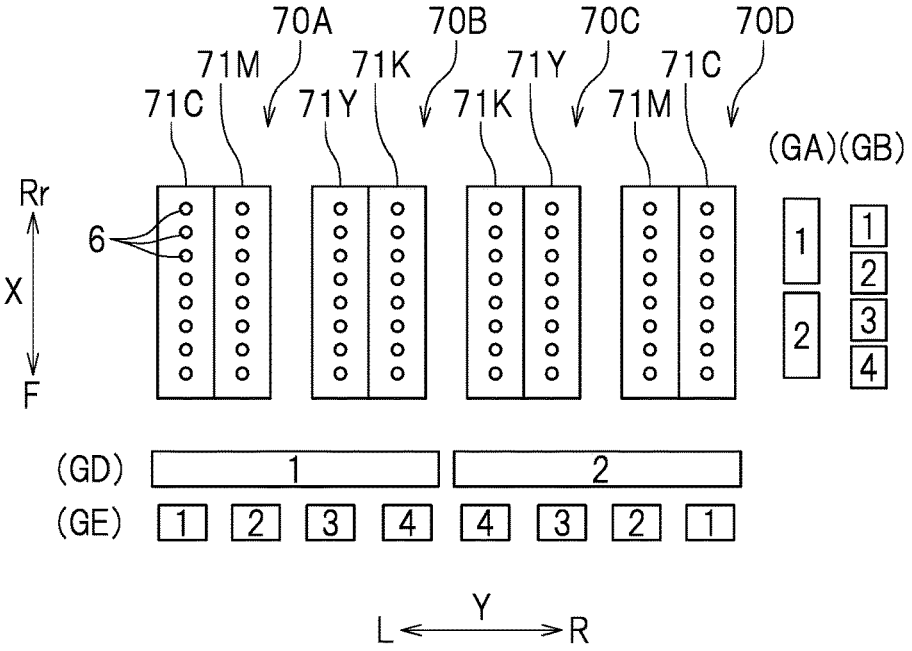

In the example shown in FIG. 7D, the printer preferably includes four injection heads 70A, 70B, 70C and 70D, for example. The injection heads 70A, 70B, 70C and 70D are arrayed in a so-called in-line arrangement. In other words, the injection heads 70A, 70B, 70C and 70D are arrayed in the main scanning direction Y. The injection heads 70A and 70D each include two head portions 71C and 71M arrayed in the main scanning direction Y. The injection heads 70B and 70C each include two head portions 71Y and 71K arrayed in the main scanning direction Y. Letters C, M, Y and K respectively represent the same colors of ink as those in the preferred embodiments described above with reference to FIG. 1 and the like.

In this preferred embodiment, for example, grouping GD, by which the nozzles 6 included in the injection heads 70A and 70B are grouped into a first group, and the nozzles 6 included in the injection heads 70C and 70D are grouped into a second group, may be stored on the storage 27A. In this case, in step S2 in the preferred embodiments described above with reference to FIG. 1 and the like, the nozzles 6 included in either the injection heads 70A and 70B or the injection heads 70C and 70D may be selected as the nozzles 6 to be used for the printing.

Alternatively, in this preferred embodiment, different manners of grouping may be set for different colors of the ink. For example, regarding the cyan ink, grouping GE, by which the nozzles 6 included in the head portion 71C in the injection head 70A are grouped into a first group, and the nozzles 6 included in the head portion 71C in the injection head 70D are grouped into a second group, may be stored on the storage 27A. In this case, in step S2 in the preferred embodiments described above with reference to FIG. 1 and the like, the nozzles 6 included in either the injection head 70A or 70D may be selected as the nozzles 6 to be used for the printing. Regarding the magenta ink, the yellow ink and the black ink, substantially the same manner of grouping may be set. Still alternatively in this preferred embodiment, for example, as described above with reference to FIGS. 4A and 4B, the plurality of nozzles 6 may be grouped into a plurality of groups arrayed in the sub scanning direction X. Such grouping may be stored on the storage 27A as grouping GA or grouping GB.

In the preferred embodiments described above with reference to FIG. 7B, the printer includes the two injection heads 50A and 50B arrayed in the main scanning direction Y. The injection heads 50A and 50B each include the plurality of nozzles 6 arrayed in the sub scanning direction X. The second printing portion 27 is adapted to select either the injection head 50A or 50B. This allows the efficiency of the printing to be improved while the image quality is maintained high. Therefore, the printing quality and the productivity of printed items is better balanced, and the effect of the technology disclosed therein is better provided.

In the preferred embodiments described above with reference to FIG. 1 and the like, in step S2, the user visually checks the test pattern for the nozzle check and specifies the position of the nozzle 6 having an injection defect. The present invention is not limited to this. For example, the printer 1 shown in FIG. 1 includes an optical meter 33 capable of recognizing the test pattern printed on the medium 5. An example of the optical meter 33 may be, for example, an image capturing device such as a camera or the like, a color meter or the like. The optical meter 33 automatically specifies the position of the nozzle 6 having an injection defect. In FIG. 1, the optical meter 33 is mounted on the carriage 30. The optical meter 33 is not limited to being mounted on the carriage 30. The optical meter 33 may be provided in, for example, the printer main body 10 or the like. In the case where the user visually checks the test pattern for the nozzle check, the optical meter 33 is not absolutely necessary, and may be omitted.

In this preferred embodiment, the printer 1 includes the optical meter 33 reading the test pattern for the nozzle check. The second printing portion 27 is adapted to detect whether or not any of the nozzles 6 has an injection defect by use of the optical meter 33. The use of the optical meter 33 allows the nozzle 6 having an injection defect to be detected objectively as compared with the case where the user visually checks the test pattern. Therefore, in the case where, for example, the user is not sufficiently skilled in the checking work, it is especially effective to use the optical meter 33.

In the preferred embodiments described above with reference to FIG. 1 and the like, the test pattern for the nozzle check is printed on the medium 5 in step S1 and the user checks the test pattern in step S2. The present invention is not limited to this. The printer 1 may automatically perform steps S1, S2 and S3. For example, the printer 1 may perform the nozzle check of automatically detecting whether or not any of the nozzles 6 has an injection defect by use of a conventionally known detection method. Based on the results of the nozzle check, the printer 1 may automatically specify the position of the nozzle 6 having the injection defect. In a specific example, a sensor capable of recognizing the ink injected from the nozzles 6 is set on the printer 1, so that the nozzle check and the specification of the position of the nozzle 6 having the injection defect may be performed automatically.

Figure 8:
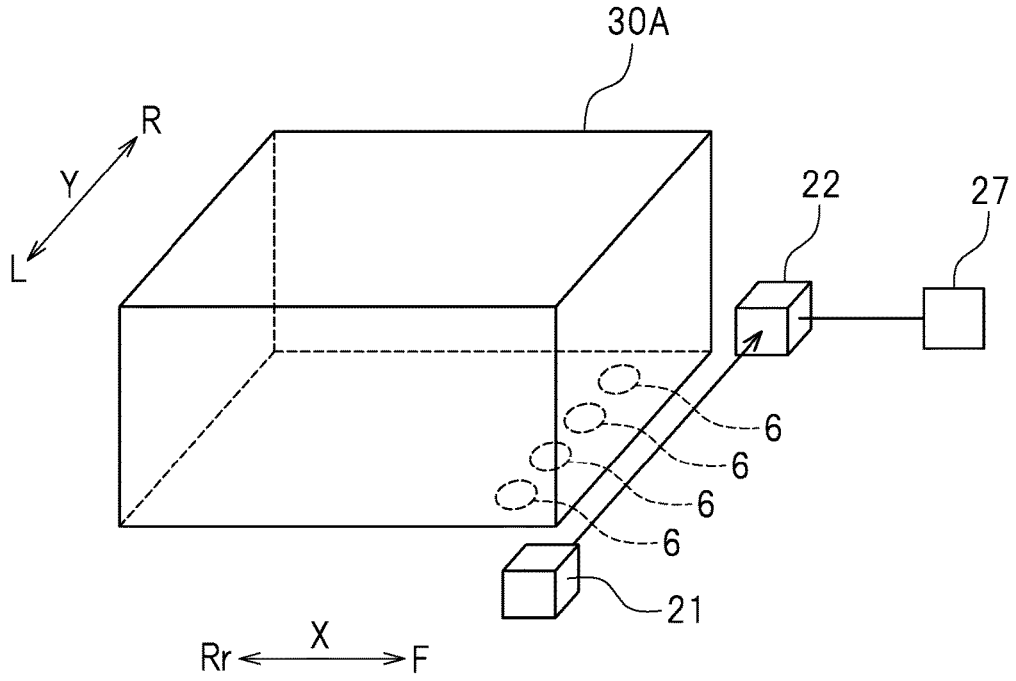
FIG. 8 is a schematic perspective view of a sensor according to a preferred embodiment of the present invention.

FIG. 8 is a schematic perspective view of a sensor according to a preferred embodiment of the present invention. FIG. 8 shows only the nozzles 6 located at the foremost positions and omits the nozzles 6 to the rear thereof. In this preferred embodiment, the printer includes a light emitting element 21 and a light receiving element 22. The light emitting element 21 is electrically connected with the nozzle checker 27B of the second printing portion 27. The light emitting element 21 emits light in the main scanning direction Y upon receipt of an instruction from the nozzle check 27B. The light emitting element 21 is, for example, a light emitting diode (LED). The light receiving element 22 is located to face the light emitting element 21 such that a path of ink drops emitted from the nozzles 6 is between the light emitting element 21 and the light receiving element 22. The light receiving element 22 receives the light emitted by the light emitting element 21. The light receiving element 22 is, for example, a photodiode. The light receiving element 22 is electrically connected with the nozzle selector 27C of the second printing portion 27. Based on the amount of light detected by the light receiving element 22, the nozzle selector 27C determines the position of the nozzle 6 having the injection defect. The light emitting element 21 and the light receiving element 22 act together as a sensor.

This will be described in more detail. For example, the plurality of nozzles 6 inject ink drops sequentially from the leftmost nozzle 6 at a predetermined time interval. If the nozzle has no injection defect, the light emitted from the light emitting element 21 is blocked by the injected ink drops. Therefore, the intensity of the light received by the light receiving element 22 is decreased. By use of such a principle, it is detected sequentially whether or not any of the nozzles 6 has an injection defect. The nozzle selector 27C is adapted to select nozzles 6 from which the ink is to be injected for the printing, based on the results thereof. In a preferred embodiment of the present invention, the nozzle selector 27C is adapted to select two or more (a plurality of) nozzles 6 as the nozzles 6 usable for the printing. The number of the nozzles 6 to be used is increased, so that an image is printed in a larger region at once. This increases the productivity of printed items. It is especially preferred that the nozzle selector 27C is adapted to select a plurality of nozzles 6 continuously arrayed in the sub scanning direction X, such that the number of the selected nozzles 6 is maximum. In this case, the timing at which the ink injected from the nozzles 6 is dried is made uniform. This more effectively prevents the image quality from being decreased. The printer uses the selected nozzles 6 to print the image.

In the preferred embodiment shown in FIG. 8, the printer includes the sensor (the light emitting element 21 and the light receiving element 22). The second printing portion 27 is adapted to use the sensor to automatically detect whether or not any of the nozzles 6 has an injection defect and is also adapted to automatically select the nozzles 6 from which the ink is to be injected. In this manner, for example, the nozzles 6 to be used for the printing are appropriately selected without being restricted by the grouping stored on the storage 27A. Thus, the efficiency of the printing is optimized while the printing image quality is maintained high.

In the above-described preferred embodiments, the grouping on the nozzles 6 is stored in advance on the storage 27A. In step S2 in the preferred embodiments described above with reference to FIG. 1 and the like, the nozzles 6 to be used for the printing are selected based on the grouping stored on the storage 27A. The present invention is not limited to this. For example, in the case where the user is skilled in the work, the user may check the test pattern for the nozzle check and select the nozzles 6 to be used for the printing himself/herself. In this case, the second printing portion 27 does not need to include the storage 27A.

In the preferred embodiments described above with reference to FIG. 1 and the like, the printer 1 is adapted such that the carriage 30 moves in the main scanning direction Y, and the medium 5 moves in the sub scanning direction X. The present invention is not limited to this. The carriage 30 and the medium 5 move with respect to each other. Either one of the carriage 30 and the medium 5 may move in the main scanning direction Y or in the sub scanning direction X. For example, the medium 5 may be immovable, whereas the carriage 30 may be movable in both of the main scanning direction Y and the sub scanning direction X. Alternatively, the carriage 30 and the medium 5 may be both movable in both of the main scanning direction Y and the sub scanning direction X. There is no specific limitation on the structure of the printer 1. The printer 1 may be, for example, a flatbed printer. The printer 1 may include an illumination device outputting ultraviolet light, or may include a cutting head cutting the medium 5.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principle of the present invention. These preferred embodiments are provided with the understanding that they are not intended to limit the present invention to the preferred embodiments described in the specification and/or shown in the drawings. The present invention is not limited to the preferred embodiments described herein. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or referred to during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An inkjet printer, comprising:

a table on which a recording medium is able to be placed;

an injection head including a plurality of nozzles arrayed in a first direction, the injection head injecting an image-forming ink toward the recording medium;

a movement mechanism moving, in the first direction, one of the table and the injection head with respect to the other of the table and the injection head; and a controller communicably connected with the injection head and the movement mechanism, the controller driving the injection head and the movement mechanism; wherein the controller includes a first printing controller printing an image by use of a portion of the plurality of nozzles, the portion being selected based on a nozzle check to determine whether or not any of the plurality of nozzles has an injection defect;

the injection head includes, from the plurality of nozzles, a plurality of nozzles that inject the image-forming ink of a same color; and the first printing controller prints an image by using a portion of the plurality of nozzles that inject the image-forming ink of the same color.

2. The inkjet printer according to claim 1, wherein the first printing controller is configured or programmed to select, from the plurality of nozzles, a plurality of nozzles continuously arrayed in the first direction.

3. The inkjet printer according to claim 1, wherein the first printing controller includes a storage storing the plurality of nozzles grouped into a plurality of groups, and is configured or programmed to select a group that does include any of the plurality nozzles determined to have an injection defect, from the plurality of groups.

4. The inkjet printer according to claim 3, wherein in the case where the plurality of groups stored on the storage include a plurality of groups that do not include any of the plurality nozzles determined to have an injection defect, the first printing controller is configured or programmed to select one group or a plurality of groups continuously arrayed in the first direction, such that the number of nozzles included in the selected one group or the selected plurality of groups is a maximum.

5. The inkjet printer according to claim 1, wherein the first printing controller includes a storage storing the plurality of nozzles grouped into a plurality of groups, and is configured or programmed not to select a group including a nozzle detected as having an injection defect, from the plurality of groups.

6. The inkjet printer according to claim 1, wherein the first printing controller is configured or programmed to cause the plurality of nozzles to inject the image-forming ink toward the recording medium to print a test pattern for the nozzle check.

7. The inkjet printer according to claim 6, further comprising an optical meter reading the test pattern for the nozzle check; wherein the first printing controller is configured or programmed to detect whether or not any of the plurality of nozzles has an injection defect by use of the optical meter.

8. The inkjet printer according to claim 1, further comprising a sensor detecting whether or not any of the plurality of nozzles has an injection defect; wherein the first printing controller is configured or programmed to use the sensor to automatically detect whether or not any of the plurality of nozzles has an injection defect, and is configured or programmed to automatically select nozzles, from the plurality of nozzles, from which the image-forming ink is to be injected.

9. The inkjet printer according to claim 1, wherein:

the injection head includes a first injection head and a second injection head arrayed in a second direction perpendicular or substantially perpendicular to the first direction;

the first injection head includes a portion of the plurality of nozzles arrayed in the first direction;

the second injection head includes a portion of the plurality of nozzles arrayed in the first direction; and the first printing controller is configured or programmed to select either one of the first injection head and the second injection head.

10. The inkjet printer according to claim 1, wherein the controller includes a second printing controller printing an image in a state when the portion of the plurality of nozzles is not selected.

11. The inkjet printer according to claim 10, wherein the first printing controller is configured or programmed to divide an area where the second printing controller prints by one scan into a plurality of areas along the first direction, and to print by a plurality of scans.

12. The inkjet printer according to claim 10, wherein:

the first printing controller includes a storage storing a first group and a second group in which the plurality of nozzles are divided along a first direction, the second printing controller is configured or programmed to print from the nozzles of the first group to the first printing region and to print from the nozzles of the second group to the second printing region, and the first printing controller is configured or programmed to print from the nozzles of the first group to the first printing region and the second printing region.

13. The inkjet printer according to claim 10, wherein:

the injection head is configured to be movable in a second direction perpendicular or substantially perpendicular to the first direction, and the first printing controller is configured or programmed to perform printing with scanning the injection head in the second direction more than twice as compared with the second printing controller performs printing.

14. A printing method performed by use of an inkjet printer including a table on which a recording medium is able to be placed, an injection head including a plurality of nozzles arrayed in a first direction, the injection head injecting an image-forming ink toward the recording medium, a movement mechanism moving, in the first direction, one of the table and the injection head with respect to the other of the table and the injection head, and a controller communicably connected with the injection head and the movement mechanism, the controller driving the injection head and the movement mechanism, the printing method comprising:

a nozzle check step of performing a nozzle check of detecting whether or not any of the plurality of nozzles has an injection defect;

a nozzle selection step of selecting a nozzle from which the image-forming ink is to be injected, from the plurality of nozzles, based on results of the nozzle check; and a printing execution step of printing an image by use of the selected nozzle; wherein the injection head includes, from the plurality of nozzles, a plurality of nozzles that inject the image-forming ink of a same color; and the method further comprising printing an image by using a portion of the plurality of nozzles that inject the image-forming ink of the same color.

15. The printing method according to claim 14, wherein the plurality of nozzles included in the injection head include a first group of nozzles injecting the image-forming ink toward a first printing region, and a second group of nozzles injecting the image-forming ink toward a second printing region;

in a case where any nozzle in the first group of nozzles is detected as having an injection defect in the nozzle check step, the second group of nozzles is selected; and in the printing execution step, the image-forming ink is injected from the second group of nozzles toward the first printing region and the second printing region.

16. The printing method according to claim 14, wherein, when no injection defect is found in any nozzle, a printing is performed by using the plurality of nozzles without performing the nozzle selection step and the printing executing step.

* * * * *